United States Patent [19]

Jett, III et al.

[11] 4,011,686

[45] Mar. 15, 1977

[54] DOOR INTERLOCK SECURITY DEVICE

[75] Inventors: Edgar A. Jett, III; Maurice L. Phillips, both of Richmond, Va.

[73] Assignee: Carmine Foods, Inc., Richmond, Va.

[22] Filed: Aug. 4, 1975

[21] Appl. No.: 601,668

[52] U.S. Cl. ..... 49/68; 292/218

[51] Int. Cl.[2] ..... E06B 7/00

[58] Field of Search ..... 49/68; 292/DIG. 18, 292/218

[56] References Cited

UNITED STATES PATENTS

| | | | |
|---|---|---|---|
| 356,269 | 1/1887 | Branch | 292/218 |
| 1,603,404 | 10/1926 | Proctor | 49/68 |
| 1,632,683 | 6/1927 | Tracy | 49/68 X |
| 3,174,193 | 3/1965 | Smith | 49/68 |

*Primary Examiner*—Kenneth Downey
*Attorney, Agent, or Firm*—Griffin, Branigan and Butler

[57] ABSTRACT

A transfer-chamber two-door interlock security device includes a rocker arm which can be rocked between first and second door locking positions. If the rocker arm is in a first-door locking position and the second door is opened, a latch flange on the rocker arm engages an edge of the open door to thereby prevent the rocker arm from rocking.

11 Claims, 5 Drawing Figures

FIG.1
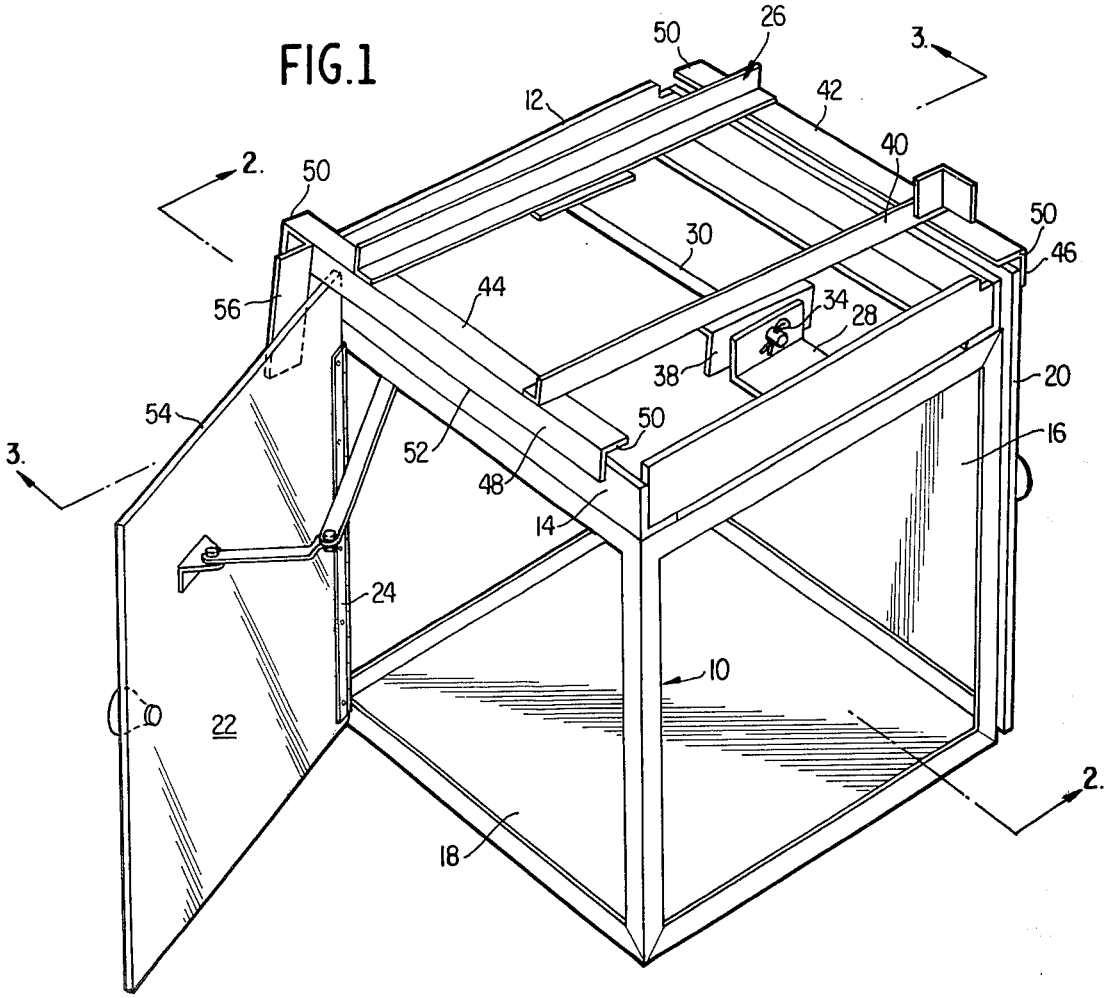
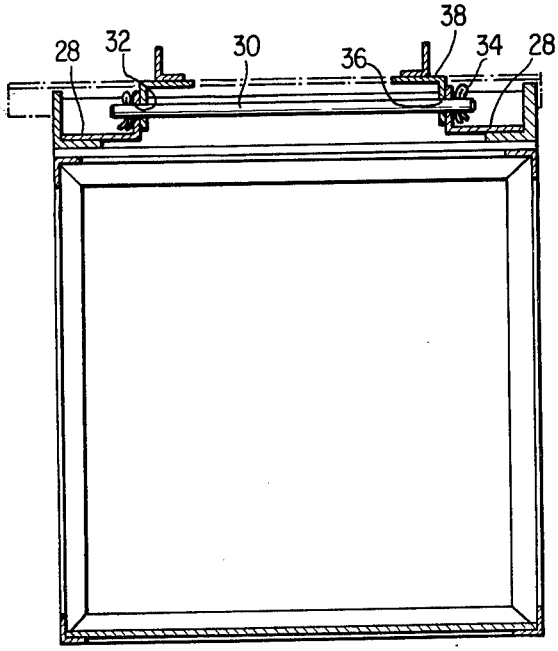
FIG.2

DOOR INTERLOCK SECURITY DEVICE

BACKGROUND OF THE INVENTION

This invention relates broadly to the art of security devices, and more particularly to devices for preventing one door to a transfer chamber from opening when another is already open.

Armed robberies of cashiers in stores, especially those of the fast-food take-out shops, constitute a serious problem. Such holdups can cause a lowering of employee morale to the point that it is difficult to find employees willing to work in questionable neighborhoods or at night in any neighborhood. Further, customers are wary of coming into stores that have experienced holdups.

U.S. Pat. No. 3,669,038 to Watson suggests the use of a transfer or delivery chamber having an attendant and a customer door. The customer door remains closed until the attendant has placed an order in the chamber through the attendant door and closed the attendant door. The customer door is then automatically opened to allow the customer to retrieve the order. A problem with the system described in Watson is that it is unduly complicated, in that it requires a motor and electronic linkage to the motor. Further, it is easily subject to malfunctions which are not easily correctable without utilization of a repairman.

Other U.S. patents which describe two-door chamber systems are: U.S. Pat. Nos. 1,393,149 and 1,403,559 to Matchette; 1,570,207 to Craw; 1,603,404 to Proctor; 1,670,372, 1,673,291, and 1,686,831 to Matchette; 3,054,555 to Saxon; 3,110,438 to Leckner; 3,129,967 to Shoenfeld; and 3,174,193 to Smith.

Although these systems employ mechanical linkages between the doors, rather than electrical linkages as does Watson, most of them require more than one lever and all of them are unduly complicated in structure and operation. In addition, most of these systems appear to be somewhat fragile, lacking in durability and strength, subject to malfunctions and can be easily circumvented.

Thus, it is an object of this invention to provide a two-door transfer-chamber system which is uncomplicated, inexpensive to manufacture, durable, reliable and strong.

SUMMARY

According to principles of this invention, the linkage between two doors of a transfer chamber includes a rocker arm having latch flanges at opposite ends thereof. The latch-flanges serve to both latch the doors and to contact the edges of the doors or door flanges, when they are open to hold the rocker arm in a position for locking the opposite respective door.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is an isometric view of an unmounted two-door transfer-chamber security device employing principles of this invention;

FIG. 2 is a sectional view taken on line 2—2 of FIG. 1;

DESCRIPTION OF THE PREFERRED EMBODIMENT

Figure 3:
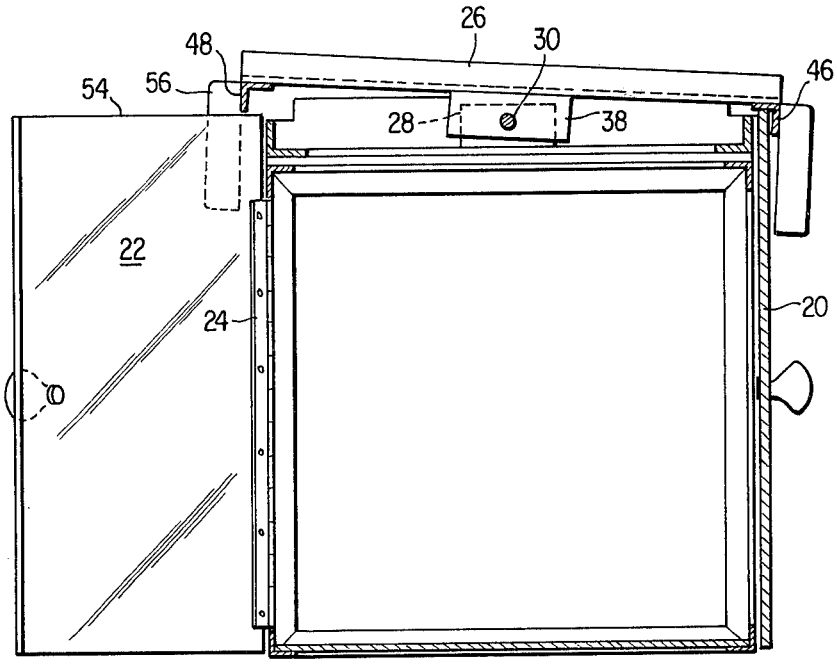
FIG. 3 is a sectional view taken on line 3—3 of FIG. 1.

Referring now to FIGS. 1–3, a two-door transfer chamber security device comprises a rigid integral frame 10 which includes top L-shaped side bars 12 and end bars 14. The frame 10 forms an attendant opening 16 and a customer opening 18, and has mounted thereon an attendant door 20 and a customer door 22 by means of hinges 24. The doors 20 and 22 are rotatable between closed positions in which they abut the frame 10 (in which position the attendant door 20 is shown in FIG. 1) and open positions in which they are rotated away from their respective openings 16 and 18 (in which position the customer door 22 is shown in FIG. 1).

A rocker arm 26 is pivotally mounted to a frame top plate by means of mounting flanges 28, which are rigidly attached to the top plate, and a mounting rod 30, which is held in holes 32 in the mounting flanges 28 by means of cotter pins 34, or the like. The rod 30 extends through holes 36 in rocker-arm mounting flanges 38. Thus, the rocker arm 26 is free to rock, or pivot, like a seesaw about the mounting rod 30.

The rocker arm 26 includes two side beams 40 which extend from the attendant's end of the frame 10 to the customer's end of the frame 10. Attendant and customer latch flanges 42 and 44 are ridigly attached to the ends of the side beams 40. The latch flanges 42 and 44 include laterally, downwardly extending latch portions 46 and 48, which serve the functions of both latching the attendant and customer doors 20 and 22 in closed positions, and preventing the rocker arm 26 from rocking when either door is in an open position. In this regard, the attendant and customer latch portions are located slightly beyond the attendant and customer doors 20 and 22 when the doors are in the closed position, so that they are moved to door blocking positions when the rocker arm 26 is rocked downwardly at their respective ends. The hinges 24 are positioned intermediate the ends 50 of the attendant and customer latch portions 46 and 48 such that when one of the doors is opened, as is the customer door 22 in FIG. 1, a bottom edge 52 of the respective latch portion contacts an upper edge 54 of the respective attendant or customer door if someone attempts to rock the rocker arm 26. Such contact prevents the rocker arm 26 from rocking and thereby holds the opposite latch portion in a blocking position so that the opposite door is maintained closed.

Figure 4:
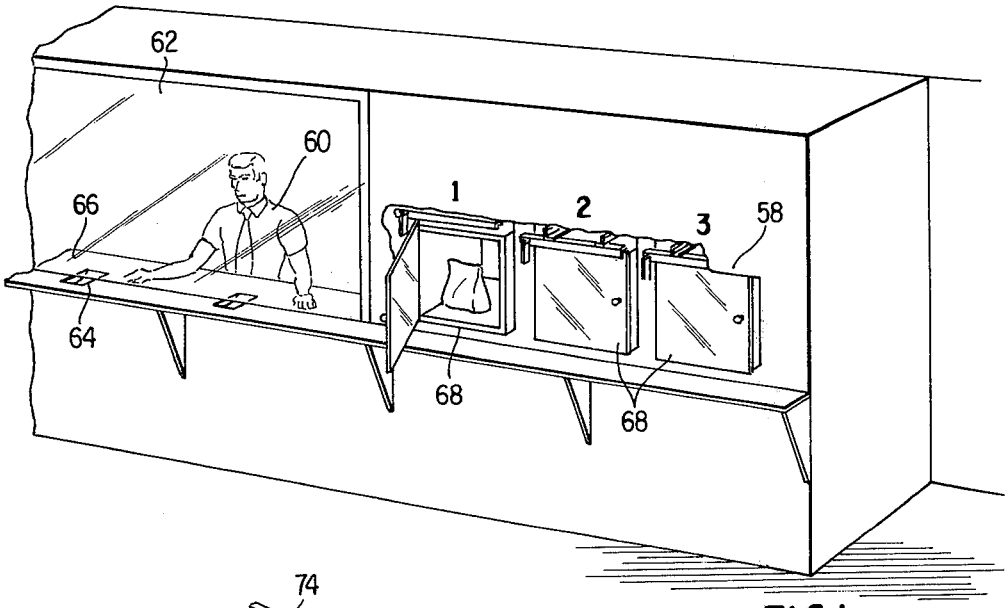
FIG. 4 is an isometric, partially cutaway view of a group of two-door transfer-chamber security devices of FIGS. 1–3 mounted at a take-out order shop.

A handle or door stop 56, is attached to the rocker arm 26, to allow the rocker arm to be rocked and to prevent over-travel by the door 22. In this regard, the two-door transfer chamber security device of this invention may be mounted, as shown in FIG. 4, so that the rocker arm mechanism is hidden by a wall 58 or a cover. In the preferred embodiment, the attendant controls the rocker arm which is spring-loaded (not shown) or weighted to automatically rock to the attendants's side. However, in another embodiment, the customer can lift the handle or door stop 56 in order to open his door. In either case, experience has shown that customers readily understand how the two-door transfer chamber of this invention works, and that it is unnecessary to explain the device to new customers.

In the preferred embodiment, the customer door 22, is constructed of a bullet proof, transparent material, such as that sold under the trademark LEXAN for example, while the attendant door 20 may be constructed of either a transparent or a nontransparent bulletproof material. In this respect, it is desirable that the customer door be transparent so that he can see when his order has been placed in the chamber.

The arrangement of security devices shown in FIG. 4 is intended to be illustrative only. Normally, where two or more devices are used in tandum, each such device is adjacent to a specific cash register and waiting station.

In operation, with reference to FIG. 4, a customer places his order with an attendant 60 through a transparent, bulletproof window 62. He pays for his order through a curved tray 64, or the like, which is cut in a counter 66 below the lower edge of the bulletproof window 62. The attendant 60 prepares the order and when it is ready, the attendant rocks to rocker arm 26 of an appropriate transfer chamber 68, so that he can open the attendant door 20. If a customer has the customer door 22 open when the attendant attempts to rock the rocker arm 26, the customer latch portion 48 will engage the top edge of the customer door 22 and not allow the rocker arm 26 to rock. Thus, the attendant cannot open his door 20. Likewise, once the attendant has opened his door 20, the customer cannot rock the rocker arm 26 to open the customer door 22, since the attendant latch portion 46 now contacts the upper edge of the attendant door 20 when such an attempt is made.

The two-door linking mechanism of this invention is uncomplicated, but yet it is extremely strong and durable and not unduly subject to malfunctions. Further, operation of a two-door transfer chamber employing this mechanism is quickly understood by customers who have not seen it before.

Figure 5:
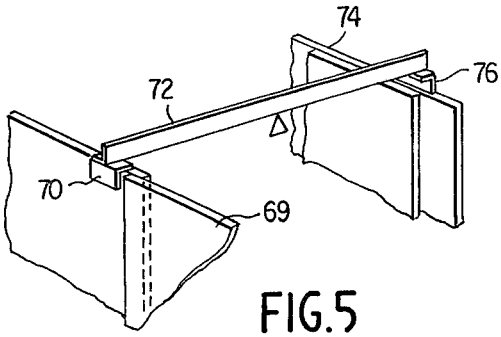
FIG. 5 is a schematic view of a sliding-door embodiment of this invention.

While the invention has been particularly shown and described with reference to a preferred embodiment, it will be understood by those skilled in the art, that various changes in form and detail may be made therein without departing from the spirit and scope of the invention. For example, the rocker arm 26 could be located below the attendant and customer doors 20 and 22, or, it could be located intermediate the upper and lower edges of the doors if slots are cut in the doors. Also, the attendant and customer latch members 42 and 44 could be divided into two parts, one for blocking the opening of a door and the other for contacting the edge of the door when it is open to prevent the rocker arm from rocking. In addition, the principles of this invention could be applied if the doors opened inwardly rather than outwardly or if double doors rather than single ones were used. Further, it is also possible to use the idea with sliding doors whereby the attendant and customer latch portions 46 and 48 would still serve to alternately block door movement and contact the tops of doors to prevent the rocker arm from rocking. Such an embodiment is depicted schematically in FIG. 5 wherein a sliding door 69 is prevented from opening by a flange 70, and a rocker arm 72 is prevented from rocking by the upper edge of an open sliding door 74 blocking movement of a flange 76. In this case, the flanges 70 and 76 lie in the planes of the doors 69 and 74.

The embodiment of the invention in which an exclusive property or privilege are claimed are defined as follows:

1. A security device comprising:

a frame for defining a chamber;

first and second doors mounted to said frame adjacent openings into said chamber for movement between closed positions, in which they cover said openings, and open positions, in which they do not cover said openings; and a rigid rocker arm having first and second opposite extremities located adjacent to edges of corresponding first and second doors, said rigid rocker arm being mounted to said frame for rocking movement between a first-door blocking position and a second-door blocking position, each of said first and second extremities of said rocker arm including a latch means for alternately occupying a blocking position blocking the movement of said corresponding door from said closed to said open position and a non-blocking position allowing said corresponding door to move from said closed to said open position, said latch means moving between said blocking and unblocking positions when said rocker arm rocks, and for engaging an edge of said corresponding door when said corresponding door is in an open position to prevent the rocker arm from rocking.

2. A security device as claimed in claim 1 wherein said latch means are for engaging the outer edges of said doors.

3. A security device as claimed in claim 2 wherein said latch means are for engaging the uppermost edges of their corresponding doors when said corresponding doors are open to prevent the rocker arm from rocking.

4. A security device as claimed in claim 3 wherein said rocker arm and latch means form a single integral member.

5. A security device as claimed in claim 4 wherein said rocker arm rotates on a rod mounted to said frame.

6. A security device as claimed in claim 1 wherein said doors are pivotally mounted to said frame for pivotal movement between said closed and open positions, and wherein said latch means are elongated bars which lie in planes parallel to said doors when said doors are in said closed positions, but which are laterally spaced from the planes of said doors, said doors pivoting about axes on said frame which are intermediate said latch means.

7. A security device as claimed in claim 6 wherein said latch means are for engaging the outer edges of said doors.

8. A security device as claimed in claim 7 wherein said latch means are for engaging the uppermost edges of their corresponding doors when said corresponding doors are open to prevent the rocker arm from rocking.

9. A security device as claimed in claim 8 wherein said rocker arm and latch means form a single integral member.

10. A security device as claimed in claim 9 wherein said rocker arm rotates on a rod mounted to said frame.

11. A security device as claimed in claim 1 wherein said doors are slideably mounted to said frame for sliding movement between said closed and open positions, and wherein said latch means lie in the planes of said doors.

* * * * *